United States Patent [19]

Hennon et al.

[11] Patent Number: 4,518,017

[45] Date of Patent: May 21, 1985

[54] PROTECTIVE COVER ASSEMBLY

[75] Inventors: Erin D. Hennon, Lima; Robert G. Joyner, Toledo, both of Ohio

[73] Assignee: Dana Corporation, Toledo, Ohio

[21] Appl. No.: 562,265

[22] Filed: Dec. 16, 1983

[51] Int. Cl.[3] ..... F16L 57/00; B65D 85/06

[52] U.S. Cl. ..... 138/96 R; 138/110; 206/303; 206/69; 206/318; 206/446; 150/54 B

[58] Field of Search ..... 138/110, 96 R, 96 T; 464/185; 411/352, 371, 372, 373, 374, 375, 376, 377, 520, 521, 525, 526, 528; 206/318, 303, 304, 69, 446; 150/54 A, 54 B

[56] References Cited

U.S. PATENT DOCUMENTS

| | | | |
|---|---|---|---|
| 169,889 | 11/1875 | Cabot | 411/376 |
| 350,344 | 10/1886 | Caldwell | 206/446 |
| 1,018,185 | 2/1912 | Grimm | 150/54 A |
| 1,849,604 | 3/1932 | Weatherhead | 411/521 X |
| 2,053,918 | 9/1936 | Peretzman | 411/371 X |
| 2,828,857 | 4/1958 | Mackay | 206/446 |
| 4,304,279 | 12/1981 | Thomas | 206/304 X |

*Primary Examiner*—James E. Bryant, III

*Attorney, Agent, or Firm*—F. B. McDonald

[57] ABSTRACT

A protective cover assembly provides protection for an external surface of a tubular member. The assembly includes a cover having an axially extending annulus which overlies the external surface of the tubular member. The cover also includes an elongate projection disposed for axial extension into the bore of the tubular member. A retainer for the cover is defined by a support flange having an axially extending portion which carries a radially extending segmented flange. The segmented flange frictionally engages the elongate projection to retain the cover about the tubular member. In one preferred embodiment, the tubular member is an end yoke of a universal joint, and the external surface to be protected is a ground bearing sleeve. In another, the tubular member is a companion flange of a universal joint.

10 Claims, 4 Drawing Figures

PROTECTIVE COVER ASSEMBLY

BACKGROUND OF THE INVENTION

This invention relates to protective cover devices for tubular members. More particularly, the invention relates to the protection of an external surface portion of a tubular member, as for example an exposed bearing surface of a universal joint component for safe transport.

Numerous prior art protective cover devices have been suggested and tried with varying degrees of success. However, many of such devices have afforded inadequate protection of the surfaces involved, or have been too expensive for practical use. Also, some of the protective devices have been easily removed or bumped away from the tubular member during the shipment or handling of the member. Obviously, when such a device separates from the member, the member becomes subjected to the nicks, burrs, and scratches which the protection was intended to avoid.

SUMMARY OF THE INVENTION

The protective cover assembly of the present invention provides a relatively inexpensive apparatus superior to available prior art devices in both retention of the apparatus to a tubular member and in the capacity of the apparatus for providing protection.

In a preferred form, the protective assembly includes a cover and retainer disposed for protecting an externally exposed ground bearing sleeve of a tubular universal joint component. The cover includes an elongate projection disposed for axial extention into the bore of tubular member, and an axially extending annulus spaced radially outwardly of the elongate projection. The retainer includes a support flange containing frictional gripping apparatus defined by a radially inwardly extending segmented flange. The segmented flange frictionally engages the elongate projection.

DETAILED DESCRIPTION OF PREFERRED EMBODIMENTS

Figure 1:
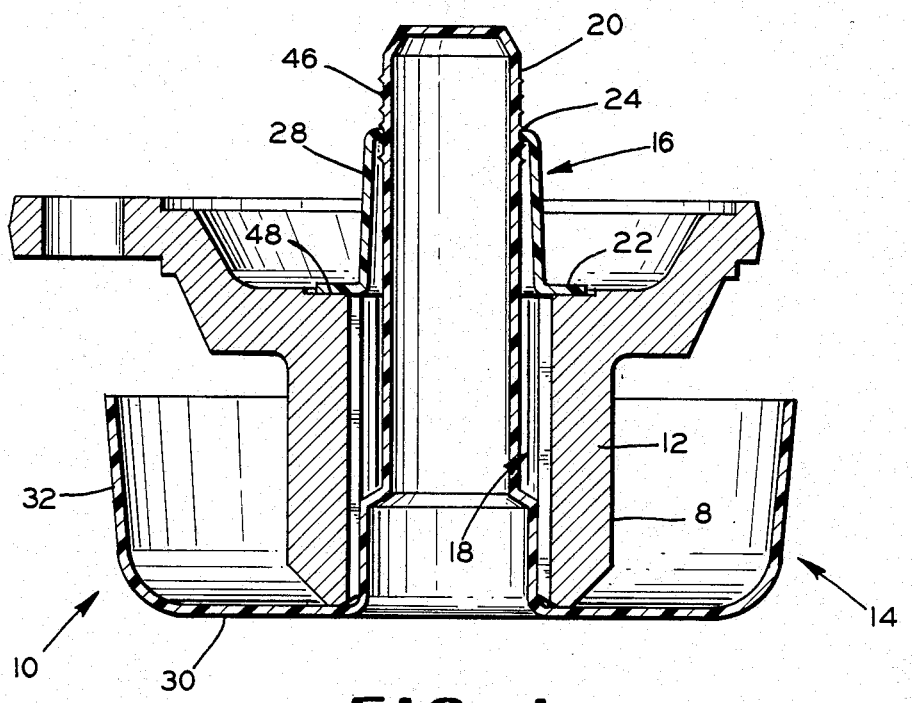
FIG. 1 is a cross sectional view of a tubular universal joint component which is shown partially encapsulated by a preferred embodiment of the protective cover assembly of the present invention.

Referring initially to FIG. 1, a protective cover assembly 10 enshrouds a tubular member such as the tubular universal joint companion flange 12, as shown. The protective cover assembly 10 includes a cover 14 and a retainer 16 for securement of the cover; the tubular member 12 being thereby axially sandwiched between the cover 14 and retainer 16. An axial bore 18 through the tubular member 12 is disposed for receiving an elongate projection 20 of the cover 14. In the preferred embodiment shown, the elongate projection 20 is an integral portion of the cover 14 which includes a radially extending annulus 30 to which the elongate projection 20 is integrally affixed. Also integrally affixed to the radially extending annulus 30 and radially spaced from the elongate projection 20 is an axially extending annulus 32 which affords protection of an external surface portion 8 of the tubular member 12. In FIG. 1, the surface 8 represents a ground bearing sleeve on the tubular companion flange 12.

Figure 2:
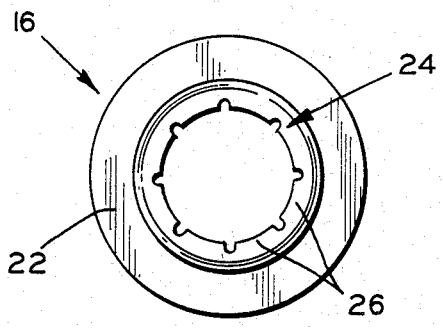
FIG. 2 is a top view of a cover retainer as employed in the embodiment of FIG. 1.

The retainer 16, shown in greater detail in FIG. 2, provides securement of the cover 14 to the tubular member 12. The retainer includes a support flange 22 which includes gripping apparatus 24 for achieving frictional engagement between the retainer and the elongate projection 20. The gripping apparatus 24 in the preferred embodiment shown in axially offset from the support flange 22 via an axial extension 28. (Conceivably, the gripping apparatus 24 could alternatively be formed in the radial plane of the flange 22.) The gripping apparatus 24 in the preferred embodiment is defined by an annular array of radially extending segments 26 which form an inside diameter smaller than that of the projection 20. The segments 26 are designed to flex in order to accommodate the projection 20. Also in a preferred form, the projection 20 includes serrations or ribs 46 over the surface thereof for enhancing securement between the apparatus 24 and the elongate projection 20.

Figure 3:
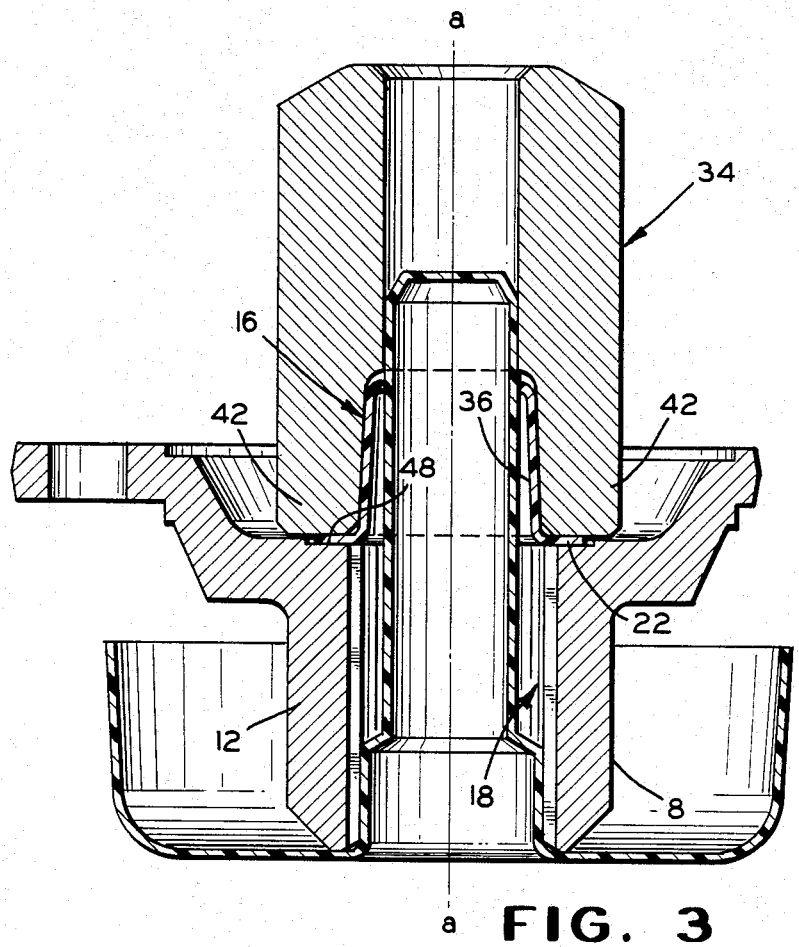
FIG. 3 is a cross sectional view of the cover assembly which includes an assembly tool utilized in assembling the retainer over the protective cover.

A special tool may be utilized for assembling the retainer 16 over the elongate projection 20 of the cover 14. Thus, referring to FIG. 3, a cover assembly tool 34 is positioned along the axis "a—a" of the bore 18 and pressed downwardly over the retainer 16. In the preferred form, the tool 34 includes a retainer engaging recess 36 which fits over the retainer 16. Legs 42 of the tool 34 are pressed down against the support flange 22 until the latter flange abuts an end surface 48 of the tubular member 12 as shown.

Figure 4:
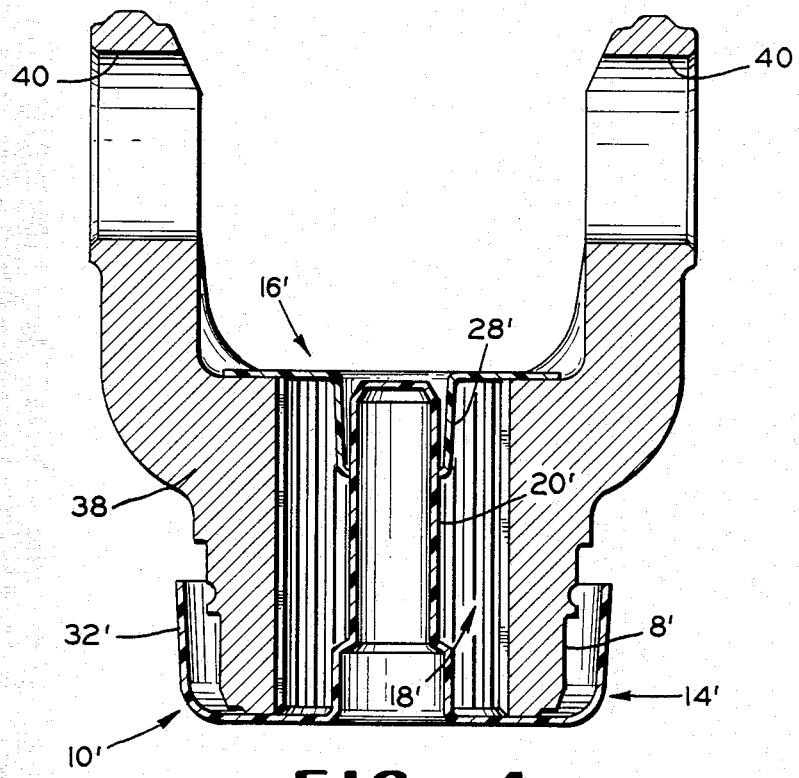
FIG. 4 is a cross sectional view of a second preferred embodiment of the protective cover assembly of the present invention.

FIG. 4 depicts another preferred embodiment 10' of the protective cover assembly of the present invention. In the latter, the tubular member is a universal joint end yoke 38 which includes a pair of bores 40 for receiving a universal joint cross member (not shown). The axially extending annulus 32' of the cover 14' protects a ground bearing sleeve 8', as in the case of the companion flange 12 of FIG. 1. However, the protective cover assembly 10' differs from the protective cover assembly 10 of FIG. 1 in that the retainer 16' has an inverted axial extension 28'. Thus, it will be apparent that the axial extension 28' extends downardly into the bore 18' of the tubular member rather than away from or out of the bore 18 as does the axial extension 28 of FIG. 1. Also, it will be noted that the elongate projection 20' does not extend completely through the bore 18' of the tubular member 38.

Finally, a preferred material for both the protective cover and retainer is a relatively soft plastic or a soft composition of polytetraflouroethylene.

Although only two embodiments have been shown and described herein, this invention is applicable to numerous variations which will fall within the appended claims.

What is claimed is:

1. A protective cover assembly comprising a cover having an axially extending annulus disposed for overlying an external surface of a tubular member, a radially extending annulus supporting said axially extending annulus, an elongate projection comprising an integral portion of said radially extending annulus and disposed for extending into the bore of said tubular member, said axially extending annulus overlying said elongate projection and adapted to cover a portion of said tubular member, said assembly further comprising a retainer for maintaining said cover in position with respect to said tubular member, said retainer comprising a support flange for engaging one end of said tubular member, and means for gripping said elongate projection comprising flexible segments on said retainer, said segments extending radially inwardly for engagement of said projection by said retainer.

2. The protective cover assembly of claim 1 wherein said means for gripping comprises a radially extending, segmented flange.

3. The protective cover assembly of claim 2 wherein said axially extending annulus of said cover is disposed for being radially spaced from contact with an external surface of a protected tubular member.

4. The protective cover assembly of claim 2 wherein said projection comprises serrations for enhancing securement between said gripping means and said projection.

5. The protective cover assembly of claim 4 wherein said support flange is axially spaced from said gripping means.

6. The protective cover assembly of claim 5 wherein said axially extending annulus is affixed to said elongate projection by an integral radially extending annulus.

7. The protective cover assembly of claim 1 wherein said tubular member is an end yoke of a universal joint.

8. The protective cover assembly of claim 1 wherein said tubular member is a companion flange of a universal joint.

9. The protective cover assembly of claim 1 wherein said external surface of said tubular member is a ground bearing sleeve.

10. A protective cover assembly comprising a cover having an axially extending annulus disposed for overlying an external surface of a tubular member, a radially extending annulus supporting said axially extending annulus, an elongate projection comprising an integral portion of said radially extending annulus and disposed for extending into the bore of said tubular member for supporting said axially extending annulus, said axially extending annulus overlying said elongate projection and adapted to cover a portion of said tubular member, said assembly further comprising a retainer for maintaining said cover in a position with respect to said tubular member, said retainer comprising a support flange for engaging said tubular member, and means for gripping said cover, wherein said means for gripping comprises a radially extending flange having flexible segments for engaging said elongate projection, and wherein said elongate projection comprises serrations for enhancing securement between said gripping means and said elongate projection.

* * * * *